US008436700B2

(12) United States Patent
Schmit et al.

(10) Patent No.: US 8,436,700 B2
(45) Date of Patent: May 7, 2013

(54) MEMS-BASED SWITCHING

(75) Inventors: Herman Schmit, Palo Alto, CA (US); Sergey Gribok, Santa Clara, CA (US)

(73) Assignee: eASIC Corporation, Santa Clara, CA (US)

( * ) Notice: Subject to any disclaimer, the term of this patent is extended or adjusted under 35 U.S.C. 154(b) by 267 days.

(21) Appl. No.: 12/562,812

(22) Filed: Sep. 18, 2009

(65) Prior Publication Data

US 2011/0067982 A1 Mar. 24, 2011

(51) Int. Cl.
*H01H 51/22* (2006.01)

(52) U.S. Cl.
USPC ..... 335/78; 200/181

(58) Field of Classification Search ..... 335/78; 200/181
See application file for complete search history.

(56) References Cited

U.S. PATENT DOCUMENTS 6,153,839 A * 11/2000 Zavracky et al. ..... 200/181
6,194,912 B1 2/2001 Or-Bach
6,236,229 B1 5/2001 Or-Bach
6,245,634 B1 6/2001 Or-Bach
6,331,733 B1 12/2001 Or-Bach et al.
6,331,789 B2 12/2001 Or-Bach
6,331,790 B1 12/2001 Or-Bach et al.
6,476,493 B2 11/2002 Or-Bach et al.
6,642,744 B2 11/2003 Or-Bach et al.
6,686,253 B2 2/2004 Or-Bach
6,756,811 B2 6/2004 Or-Bach
6,819,136 B2 11/2004 Or-Bach
6,930,511 B2 8/2005 Or-Bach
6,953,956 B2 10/2005 Or-Bach et al.
6,985,012 B2 1/2006 Or-Bach
6,989,687 B2 1/2006 Or-Bach
7,068,070 B2 6/2006 Or-Bach
7,098,691 B2 8/2006 Or-Bach et al.
7,105,871 B2 9/2006 Or-Bach et al.
7,157,937 B2 1/2007 Apostol et al.
7,436,773 B2 10/2008 Cunningham
7,439,773 B2 10/2008 Or-Bach et al.
7,473,859 B2 * 1/2009 Wright et al. ..... 200/181
7,486,539 B2 * 2/2009 Jang et al. ..... 365/149
2002/0088112 A1 * 7/2002 Morrison et al. ..... 29/622
2003/0029705 A1 2/2003 Qiu et al.
2007/0029584 A1 * 2/2007 Valenzuela et al. ..... 257/254
2010/0108479 A1 * 5/2010 Ebeling et al. ..... 200/181
2011/0089008 A1 * 4/2011 Lewis ..... 200/5 A

OTHER PUBLICATIONS

K. Akarvardar et al., "Design Considerations for Complementary Nanoelectromechanical Logic Gates," IEEE Electron Devices Meeting 2007, Washington, DC, pp. 299-302, Dec. 10-12, 2007.

* cited by examiner

*Primary Examiner* — Bernard Rojas
(74) *Attorney, Agent, or Firm* — Novak Druce Connolly Bove + Quigg LLP

(57) ABSTRACT

A MEMS-based switching device may be used to implement an interconnect switch in a programmable integrated circuit device. Such a MEMS-based device may include a deformable cantilever that may form a closed or open circuit to thereby implement switching functionality.

21 Claims, 8 Drawing Sheets

MEMS-BASED SWITCHING

FIELD OF ENDEAVOR

Various embodiments of the invention may be directed to micro-electromechanical (MEMS) switches that may be used, for example, to provide user-customizable integrated circuits.

BACKGROUND

Broadly defined, structured application-specific integrated circuits (ASICs) attempt to reduce the effort, expense and risk of producing an ASIC by standardizing portions of the physical implementation across multiple products. By amortizing the expensive mask layers of the device across a large set of different designs, the non-recurring expense (NRE) seen by a particular customer for a customized ASIC may be significantly reduced. There may be additional benefits to the standardization of some portions of mask set, which may include improved yield thru higher regularity and reduced manufacturing time from tape-out to packaged chip.

Structured ASIC products may be differentiated from other devices by the point at which the user customization occurs and how that customization is actually implemented. Most structured ASICs only standardize transistors and the lowest levels of metal. A large set of metal and via masks may still be needed in order to customize a product. This may result in only a marginal cost reduction for NRE. Manufacturing latency and yield benefits may also be compromised using this approach.

In another customizable ASIC technology, for example, as discussed in U.S. Pat. Nos. 6,194,912; 6,236,229; 6,245,634; 6,331,733; 6,331,789; 6,331,790; 6,476,493; 6,642,744; 6,686,253; 6,756,811; 6,819,136; 6,930,511; 6,953,956; 6,985,012; 6,989,687; 7,068,070; 7,098,691; 7,105,871; 7,157,937; 7,439,773; and 7,436,773 (all assigned to the assignee of the present application and incorporated by reference herein) one may, for example, standardize all but one via layer in the mask set. This single via layer may be implemented, for example, using one of two approaches:

A prototyping flow using direct-write e-beam technology eliminates the need for any mask layers. This may result in a zero-NRE product with short, fast turn around time.

A production flow using a mask layer for the vias, which may provide, for example, a 20× reduction in NRE for final production devices.

However, ASICs, and even many structured ASICs, may lack the field programmability of field-programmable gate arrays (FPGAs), which are another type of programmable logic device.

SUMMARY OF VARIOUS EMBODIMENTS OF THE INVENTION

Various embodiments of the invention may address bi-stable and/or uni-stable MEMS switching structures that may be useful in implementing programmable vias. Such programmable MEMS-based programmable vias may be used to provide customizable and programmable ASICs.

Various embodiments of the invention may also address methods for programming and/or construction of such devices and structures.

BRIEF DESCRIPTION OF THE DRAWINGS

Various embodiments of the invention will now be described in detail in conjunction with the accompanying drawings, in which reference numerals in different drawings are used to refer to common elements, and in which:

FIG. 1, which includes

DETAILED DESCRIPTION OF VARIOUS EMBODIMENTS OF THE INVENTION

MEMS technology may use lithography based manufacturing techniques, which have been used for electronic circuit design, to build moving components. In traditional electronics manufacturing, the circuit wires may generally remain embedded in material that is deposited around the metal wires. This material may often be $SiO_2$. The rigidity of this deposited material may maintain the circuit integrity. MEMS devices may, for example, be created by selectively removing this deposited material, which may allow metal structures to move due to electrostatic and/or other forces.

Using a MEMS switch to emulate a programmable via in a structured ASIC may permit changes to be made outside of the fabrication plant, which may thus allow fast design turn-around time and/or changes in the field. Both one-time programmability (where the process of configuring a design prevents the device from being configured again) and re-programmability (where the device can be reprogrammed over and over) may be useful, and MEMS-based switching may be used to configure logic and/or interconnect functions.

In some embodiments of ASICs, the MEMS switching structure(s) may be placed in a different plane from the transistors, which may allow for greater density. For example, transistors may be relegated to functions that require their capability for gain and amplification, and MEMS switches may be used in a separate layer or layers above the transistors to implement switching.

An ideal via may have infinite resistance in one state (open) and zero resistance in another state (closed). A MEMS-based switching device may thus be able to provide an approximation of a via, where an open MEMS switch may have very high resistance and a closed MEMS switch may have very low resistance.

Figure 1A:
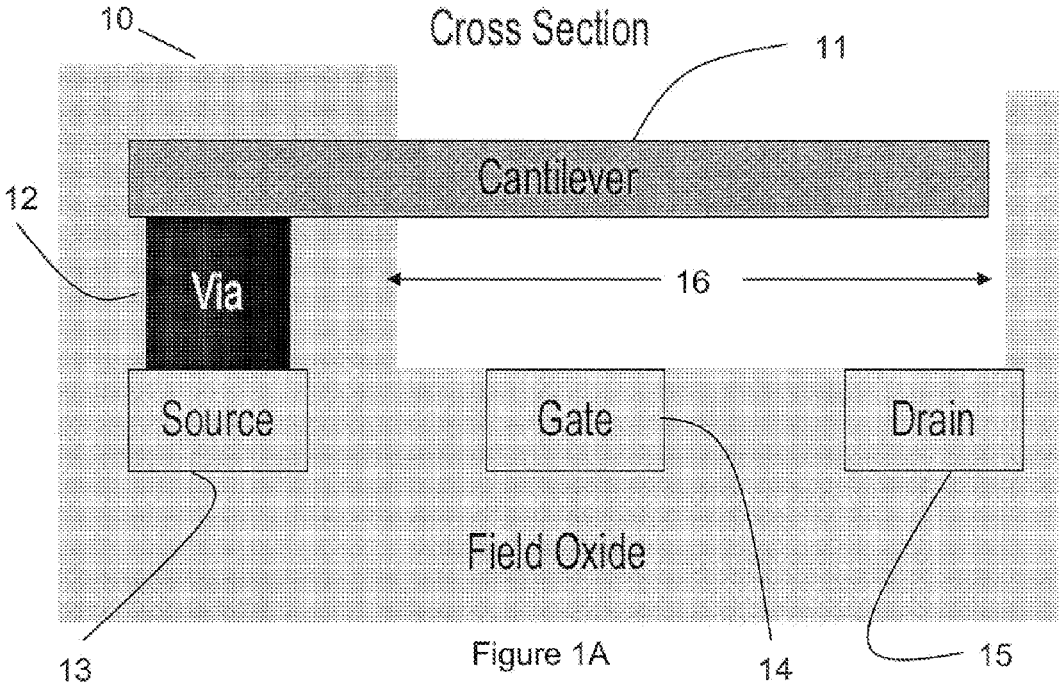
FIGS. 1A and 1B, shows cross-sectional and top-down views of a structure that may be used in embodiments of the invention.
Figure 1B:
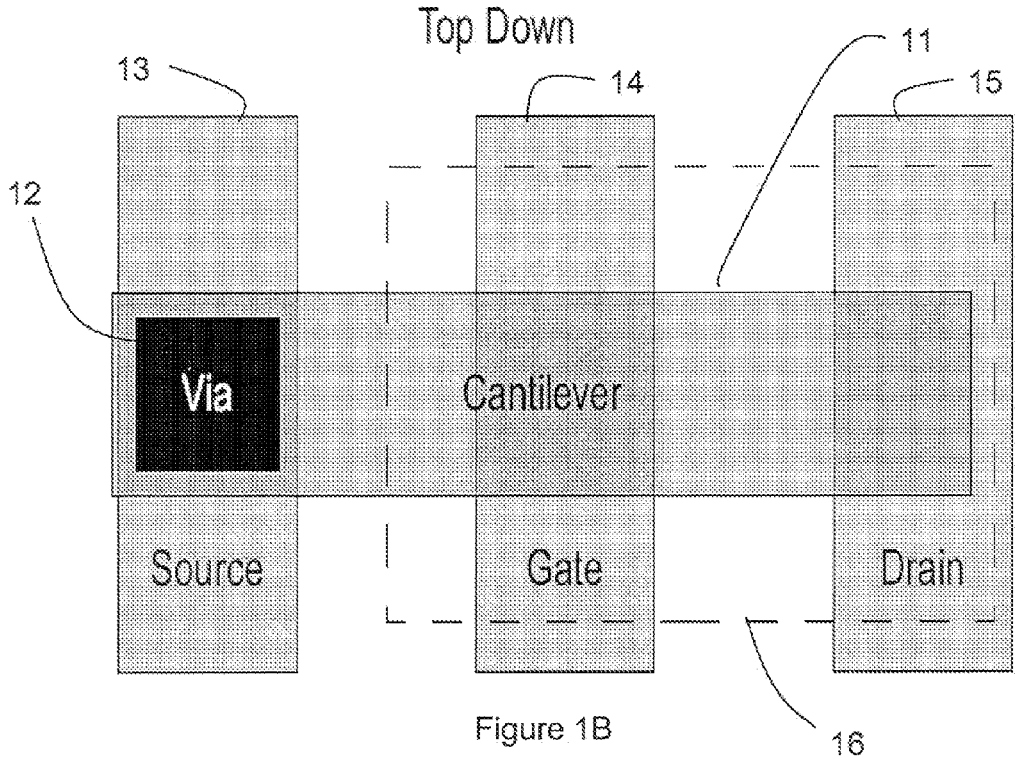

FIG. 1 illustrates a top-down view (in FIG. 1A) and a cross-sectional view (FIG. 1B) of an exemplary MEMS-based interconnect switch, as may be used in various embodiments of the invention. In this switch, the gate 14, drain 15, and source 13 may be implemented as traditional metal wires in a semiconductor integrated circuit. Like most wires in integrated circuits (ICs), they may be embedded in a deposited field oxide 10. The via 12 may connect one of those wires (the source 13 in FIG. 1) to another metal layer. In that metal layer, a wire may be constructed in a traditional manner, for example, by depositing field oxide, depositing metal, and etching unwanted metal. This wiring layer may be perpendicular to the first set of wires. Then, the field oxide around and under the cantilever 11, where the cantilever 11 overlaps the gate 14 and/or drain 15, may be etched away, leaving the cantilever 11 free in space in a switching area 16.

Given its ability to move, the cantilever may be acted upon by two primary forces: the electrostatic force between the gate and cantilever, and the electrostatic force between the drain and cantilever. If there is a voltage between the gate and source ($V_{gs}$), and/or drain and source ($V_{ds}$), the resulting attractive force may be used to pull the cantilever closer to the gate and drain.

The attractive force may be sufficient to bring cantilever 11 into contact with the drain, which may then create a conducting path between source 13 and drain 15.

The resulting device may sometimes be called a NEMS relay, or a suspended gate FET, in the literature.

There are many aspects of the design that may interact:

The thickness (W) and material of the cantilever may determine the magnitude of the mechanical force that may act against the electrical attractive force;

The magnitude(s) of the programming voltage(s), $V_{gs}$ and $V_{ds}$;

The overlapping area of the drain 15 and cantilever 11, $A_{ds}$;

The overlapping area of the gate 14 and cantilever 11, $A_{gs}$;

The distance between metal layers (e.g., between cantilever 11 and the source 13, gate 14, and/or drain 15).

Since the thickness of the cantilever 11 may, in general, be fairly small compared to normal IC wires, the cantilever 11 may have severely limited current carrying capacity. If the current carrying capacity of cantilever 11 is exceeded, the cantilever 11 may be damaged. Therefore, a cantilever 11 having limited current carrying capacity may only be useful for charging and/or discharging small capacitances.

In order to use a MEMS-based switch for programming, e.g., a structured ASIC, it may need to be able to make a closed circuit and/or open circuit and to maintain that state. That is, a bi-stable, or at least uni-stable, device may be needed.

One example of providing stability is that the maintenance of the gate-source voltage may be used to keep the cantilever 11 in contact with the drain 15. Another technique, described in U.S. Patent Application Publication No. 2003/0029705, may use a bi-stable curved beam or beam-pair that is mechanically bi-stable; that is, if it is displaced into one location, it may maintain that displacement. However, there are other techniques that may be useful for this, and which may be used in various embodiments of the invention.

First, the van der Waals attractive forces, which act as an attractive force at very close distances, may be used to keep the cantilever 11 in place after it has been brought into contact with the drain 15.

Second, the Casimir effect is another attractive force between metal surfaces at a very close range. These Casimir forces may also be used to keep the cantilever 11 in place in a similar way to that in which van der Waals forces may do so.

Third, if $V_{ds}$ is non-zero, the first instant of contact between the cantilever and drain may result in a current spike, $I_{ds}$, that may melt some small amount of the metal composing the cantilever 11 and/or drain 15. If this current is reduced carefully, the resulting metal welding may be made permanent, and this may be used to keep the switch in a closed state. This, however, is a permanent state, and is therefore not re-writable (in other words, this provides a uni-stable switching structure, which is only one-time programmable).

Fourth, if the current spike ($I_{ds}$) is great enough (higher than the current spike used for welding), it may be possible to melt the cantilever 11 and thus make the switch a permanent open circuit. Again, this provides a uni-stable switching structure, which is only one-time programmable.

Figure 2:
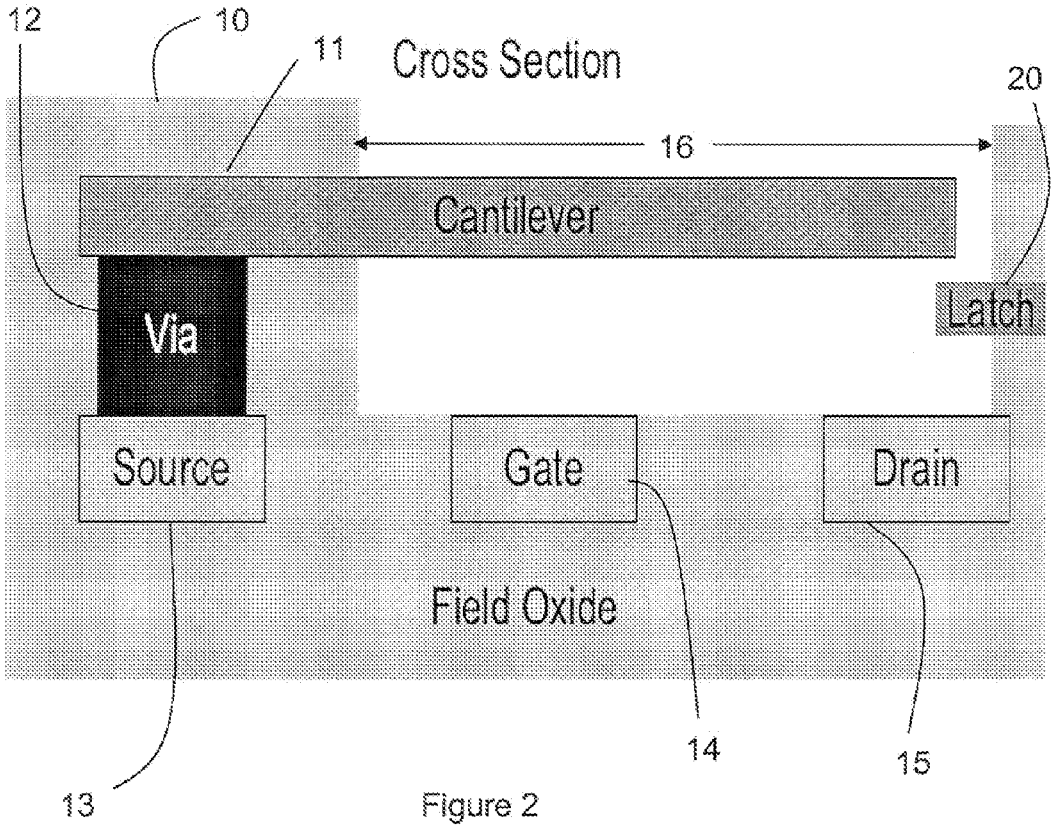
FIG. 2 shows a cross-sectional view of a structure according to an exemplary embodiment of the invention.

Fifth, one may use a mechanical locking mechanism to maintain the closed or open state of a switch. FIG. 2 shows an exemplary embodiment of the invention in which such a technique may be used. In the mechanism shown in FIG. 2, the (physical) latch 20 may be constructed from a material other than the material of the field oxide 10 so that it may be etched at a different rate from a rate at which the field oxide 10 may be etched. With the latch 20 present, the cantilever 11 may consequently have only two states, one in contact with the drain 15, and one not in contact with the drain 15. Under the attractive force of the gate 14, the cantilever 11 may deform so that it snaps past the latch 20 to be in contact with the drain 15. This act of programming the switch to a closed state may be reversible through the application of a sufficient repulsive force when the cantilever 11 is in contact with the drain 15 (e.g., by applying a voltage of opposite polarity to the gate 14 to induce an electromagnetic force sufficient to break the connection between the cantilever 11 and drain 15 and to push the cantilever 11 past latch 20 (determination of such a sufficient force/current, either for attraction or repulsion, would be within the knowledge of a skilled artisan); however, it is noted that the invention is not thus limited), the force may then cause the cantilever 11 to push away from drain 15 and past latch 20, which may then serve to move the cantilever 11 to an open position. Without a significant electrostatic force on the cantilever 11, it may normally remain in the closed or open position (i.e., in the last programmed position).

Another aspect of various embodiments of the invention is to enable one to program the switching structure (i.e., to open and/or close the switch). There are four techniques that may, for example, be used for this purpose in various embodiments of the invention:

1) Using the gate 14 as a programming signal and as a user signal;

2) Using the combination of $V_{gs}$ and $V_{ds}$ to create a sufficient programming force;

3) Using multiple gates to create sufficient programming force;

4) Using only the Drain-Source field to create the programming force.

In the first exemplary technique, in order to re-use the area dedicated to the device gate 14, after programming, the gate 14 may be used for a user signal. To create the voltage difference between the gate 14 and cantilever 11 during programming, the source 13 may be tied to one voltage and the gate 14 tied to another voltage.

Figure 3:
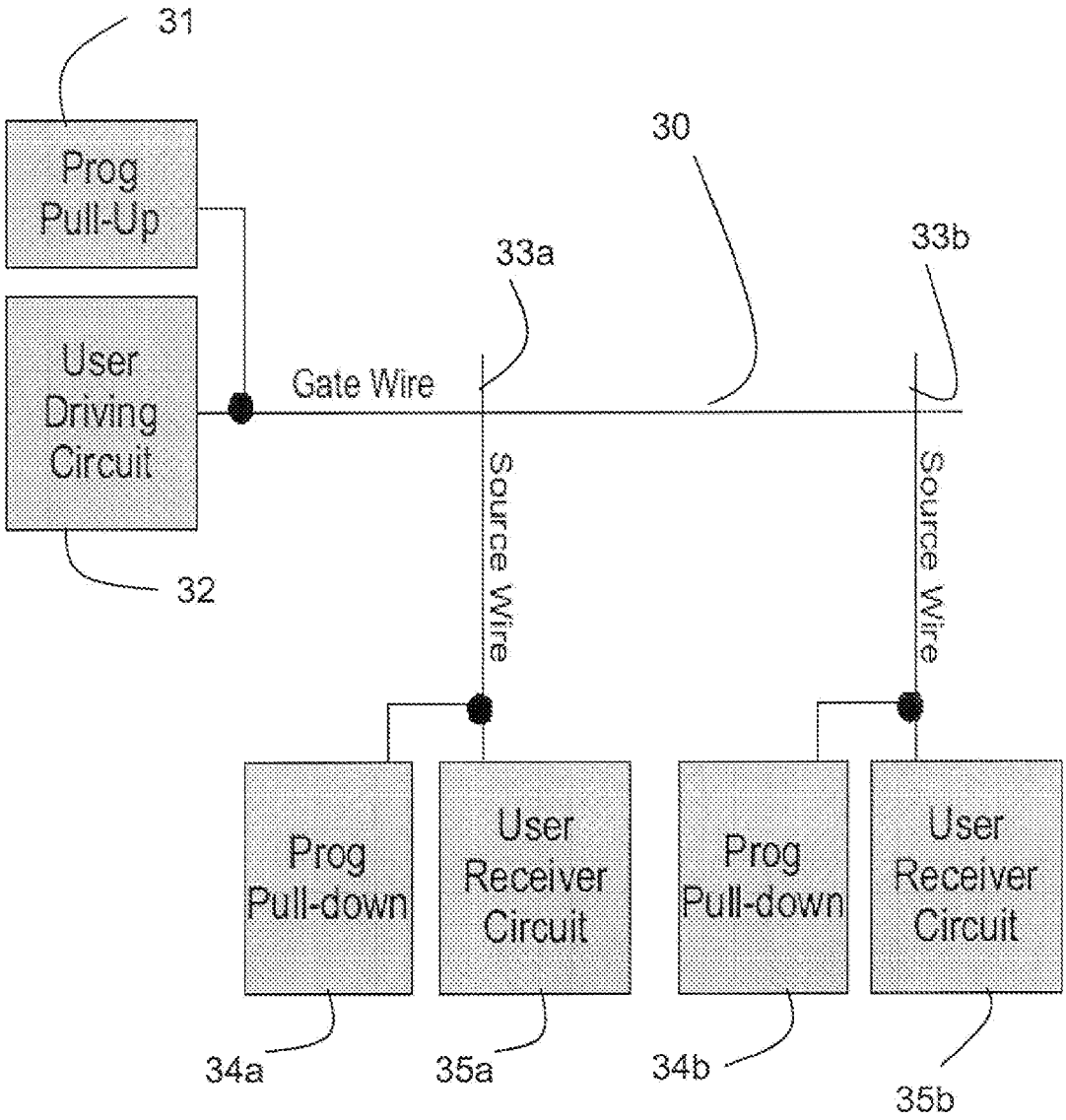
FIG. 3 shows a conceptual block diagram of an exemplary embodiment of the invention.

In order to enable the use of the user signal/wire as a part of the user design, one may build a set of devices that provide the programming voltage differential across the source 13 and gate 14. If the source terminal 13 is connected to a receiving circuit (like a buffer or inverter), the programming circuit may then appear conceptually as in FIG. 3. In FIG. 3, the programming circuit may comprise an element to provide one voltage to a gate wire 30 and another voltage to the receiving circuit 35 (35*a* and/or 35*b*), as shown.

In FIG. 3, the gate wire 30 is coupled to a programmable pull-up 31 and a user driver circuit 32. The junction of the source 33 (33*a* and/or 33*b*) and gate 30 may be activated only if both the programmable pull-up 31 (Prog Pull-Up) on the gate wire 30 is active and the programmable pull-down 34 (34*a* and/or 34*b*) (Prog Pull-down) on the source wire 33 is active. In this fashion, a gate 30 may cross-over multiple junctions with source wires 34*a* and 34*b*, and the gate wire 30 may thus be used for control of more than one junction. It is further noted that FIG. 3 shows two receivers 35*a* and 35*b* sharing the same gate wire 30 in order to illustrate that there may be more than one cantilever controlled using the same gate 30; however, the invention may involve any number of such junctions, which may correspond to cantilevers controlled by a common gate wire.

The programmable pull-up and pull-down circuits 31 and 34 may each be as simple as a transistor (PMOS or NMOS) connecting the gate 30 or source wire 33 to a fixed voltage; however, the invention is not limited to such structures. In such an embodiment, the control signal to the programmable pull-up and pull-down (the gate of the respective transistor) may be controlled by any of many programmable configuration circuits, such as row or column decoders or shift registers; but the invention is not limited to any particular control structure.

A result of re-using the gate wire 30 for the user circuit is that the cantilever may be deflected and potentially programmed when the use of the user circuit creates a voltage differential as part of the operation of the user circuit. This may create a problem of unintentional re-programming of the circuit. One or more of a number of techniques may be used to deal with this problem.

First, the programming voltage differential that the pull-down 31 and pull-up 34 circuits use may be greater than the signal voltage. This may be done, for example, by using a larger programming voltage, by using a smaller swing voltage for user signals, or by doing both. A greater programming voltage may be distributed using a separate distribution network, so that it is connected only to devices that can tolerate the higher voltage. Smaller signal voltages may be supported by many well-known circuit techniques, including, but not limited to, differential low-swing circuitry, current-sensing circuitry, or tri- or quad-rail signaling.

A second technique that may be used to separate user circuit function from programming circuit function is to "burn out" or "weld" cantilevers that should remain open or closed, respectively (as a function of the user design). That is, as described above, if too much current is passed through a cantilever, it may then burn out like a fuse, and remain permanently open, and if a lesser, but still sufficiently high, current is passed through a cantilever, a small portion of the drain and/or cantilever may melt and fuse, effectively creating a weld, causing the connection to remain permanently closed. As noted above, these may result in uni-stable programming of a connection, as they may typically cause permanent structural change that cannot be reversed.

In some applications, the construction of MEMS relays may attempt to minimize the effect of $V_{ds}$ because that may more closely emulates the behavior of an ideal switch, where the switching behavior is independent of the source and drain. In the structured ASIC application, however, ideal operation of the switch may not be the most important consideration. Therefore, increasing the overlap area of the drain 15 and cantilever 11 may be used to create more programming force. An exemplary implementation of such an embodiment, containing such programming circuitry is shown in FIG. 4.

Figure 4:
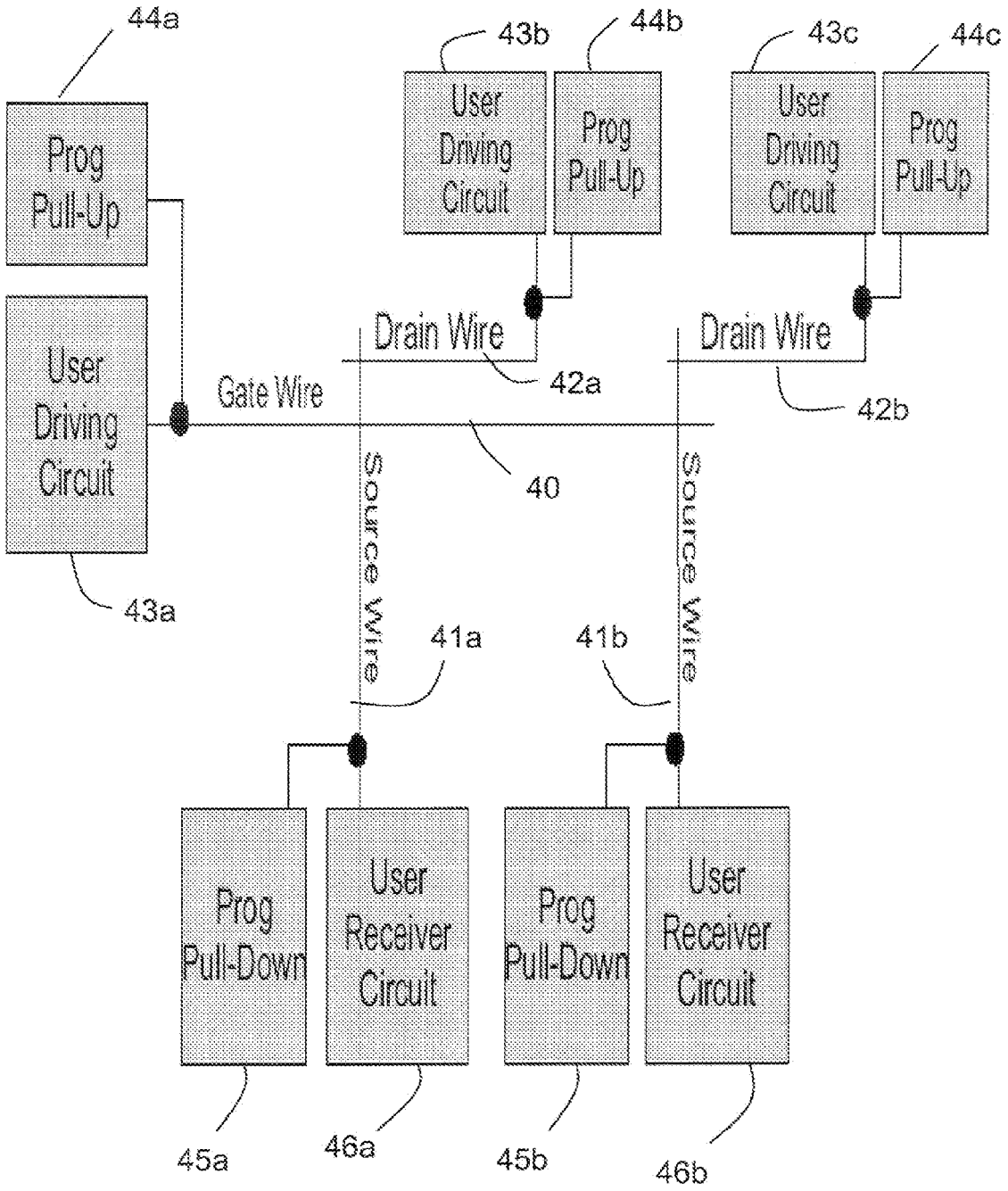
FIG. 4 shows a conceptual block diagram of an exemplary embodiment of the invention.

In FIG. 4, the drain wire 42*a* and/or 42*b* may have similar circuitry to the gate-driving wire 40 (e.g., as shown in FIG. 3), which may include a user driving circuit 43*a*/43*b*/43*c* and a programmable pull-up device 44*a*/44*b*/44*c*. Because a single wire may be used as both a gate and a drain, this may allow the circuitry coupled to the drain wire 42*a*/42*b* to be structurally identical to the gate driving circuitry (43*a*/44*a*). As in FIG. 3, there may be multiple source wires 41*a*/41*b*, which may be coupled to respective source driving circuitry (45*a*/46*a* and 45*b*/46*b*), as shown. Similarly, as shown, there may be one or more drain wires 42*a*/42*b*, which may be coupled to respective drain driving circuitry (43*b*/44*b* and 43*c*/44*c*). Programming using the circuitry shown in FIG. 4 may use three activations: the gate wire pull-up 44*a*, the drain wire pull-up 44*b* and/or 44*c*, and the source wire pull-down 45*a* and/or 45*b*. In this respect, programming is similar to programming in FIG. 3, but here, in addition to using the gate wire 40 for pull-up, the drain wire(s) 42*a* and/or 42*b* may also be used.

Figure 5:
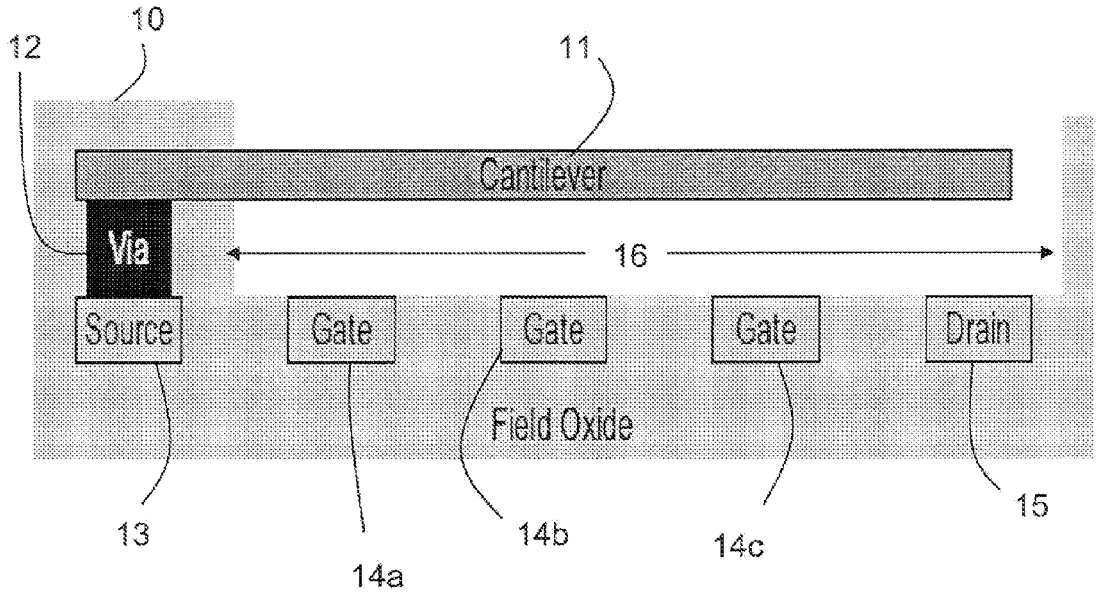
FIG. 5 shows a cross-sectional view of an exemplary embodiment of the invention.

Similar to the concept of using the drain wire(s) to provide additional voltage, it may also be possible to create multiple gates 14 for each cantilever 11. An example of such an embodiment is shown in FIG. 5. With multiple gates 14*a*/14*b*/14*c*, the electric field applied to the cantilever 11 may be increased, similar to having larger gate-cantilever cross-over area, and may also be used to differentiate user signaling from programming signals.

Figure 6:
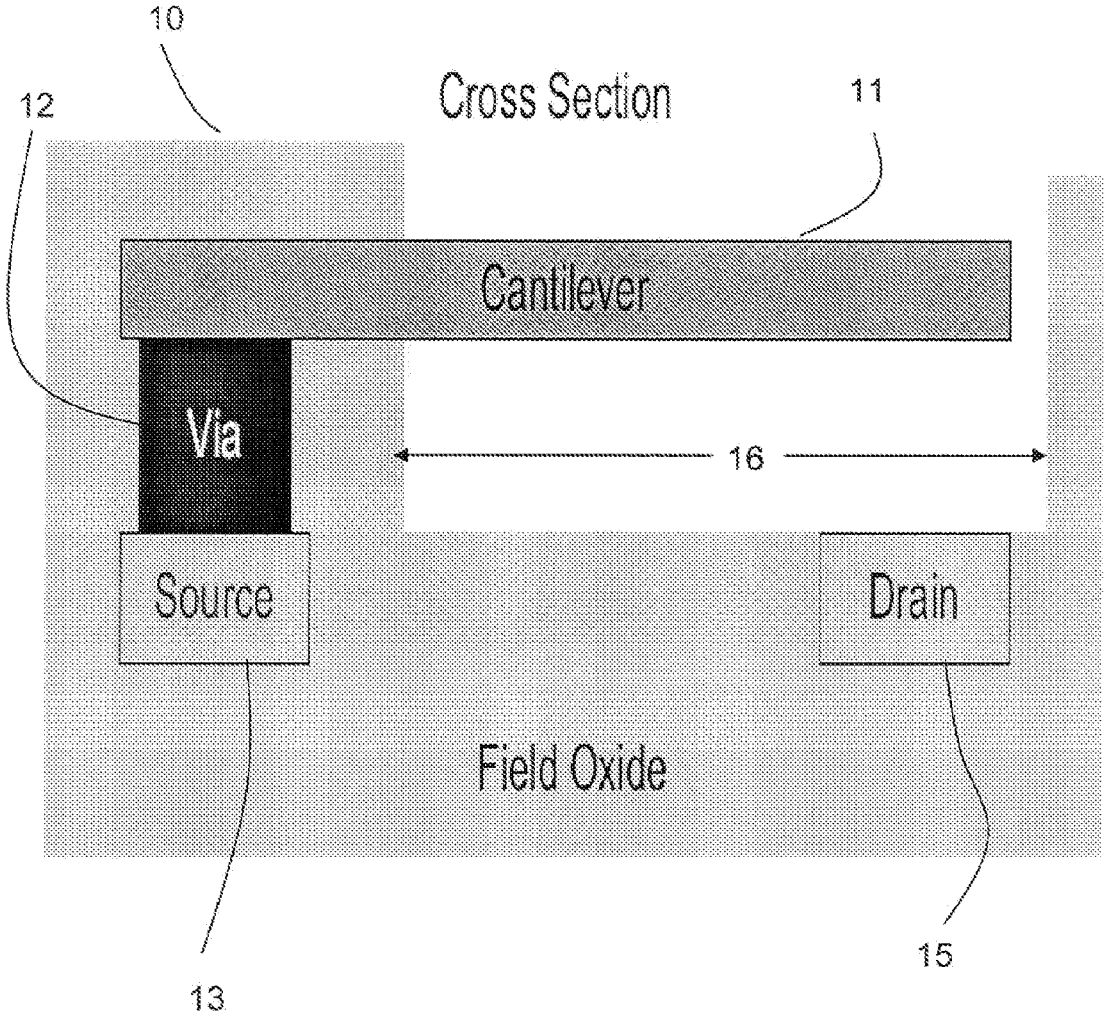
FIG. 6 shows a cross-sectional view of an exemplary embodiment of the invention.

It may also be possible to eliminate the gate 14 altogether and have just a drain-source connection, an example of which is shown in FIG. 6. In this case, the field may have to be carefully controlled, as the voltage to pull the cantilever 11 may result in a current spike when the cantilever 11 makes contact with the drain 15. This spike may exceed the current carrying capacity of the cantilever 11. However, if the voltage is carefully controlled, an attractive electromagnetic force may be generated that is Sufficient to pull the cantilever 11 toward the drain 15 to make contact.

To solve the current spike issue, it may be possible to create a static charge on the cantilever 11, by temporarily connecting the source 13 (or drain 15) to a voltage source, leaving it disconnected with a retained charge, and then connecting the drain 15 (or source 13) to a fixed voltage to create an attractive force on the cantilever 11. As a result, only the charge held by the capacitance of the source node 13 discharges thru the cantilever/drain junction.

Figure 7:
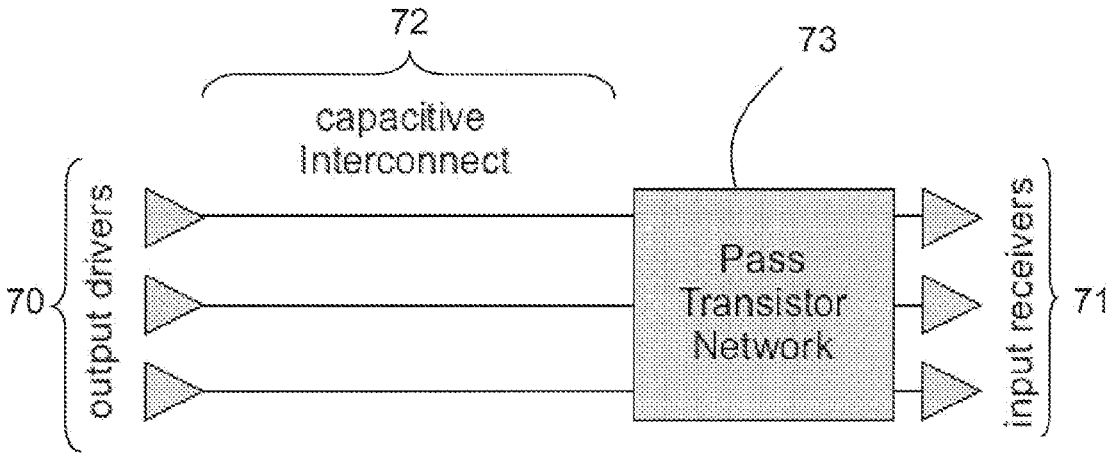
FIG. 7 shows a conceptual block diagram of a system in which various embodiments of the invention may be used.

In some applications, for example, as shown in FIG. 7, MEMS-based switches may be connected in series or parallel, as in pass-transistor logic networks 73, but with connections to user signal drivers 70 and/or small input inverters 71. If substantial interconnection 72 is involved in the circuit, it may be between the pass transistor network 73 and the driver (s) 70, as illustrated in FIG. 7, where the interconnection shown in capacitive. In this example, a source terminal of the pass transistor network 73 may be connected to either another drain or gate of a relay, or may be connected with minimal interconnect (for example, using stacked vias) to the terminal of an input receiver 71, which may be comprised of two complementary transistors, e.g., using complementary metal-oxide semiconductor (CMOS) technology.

Figure 8:
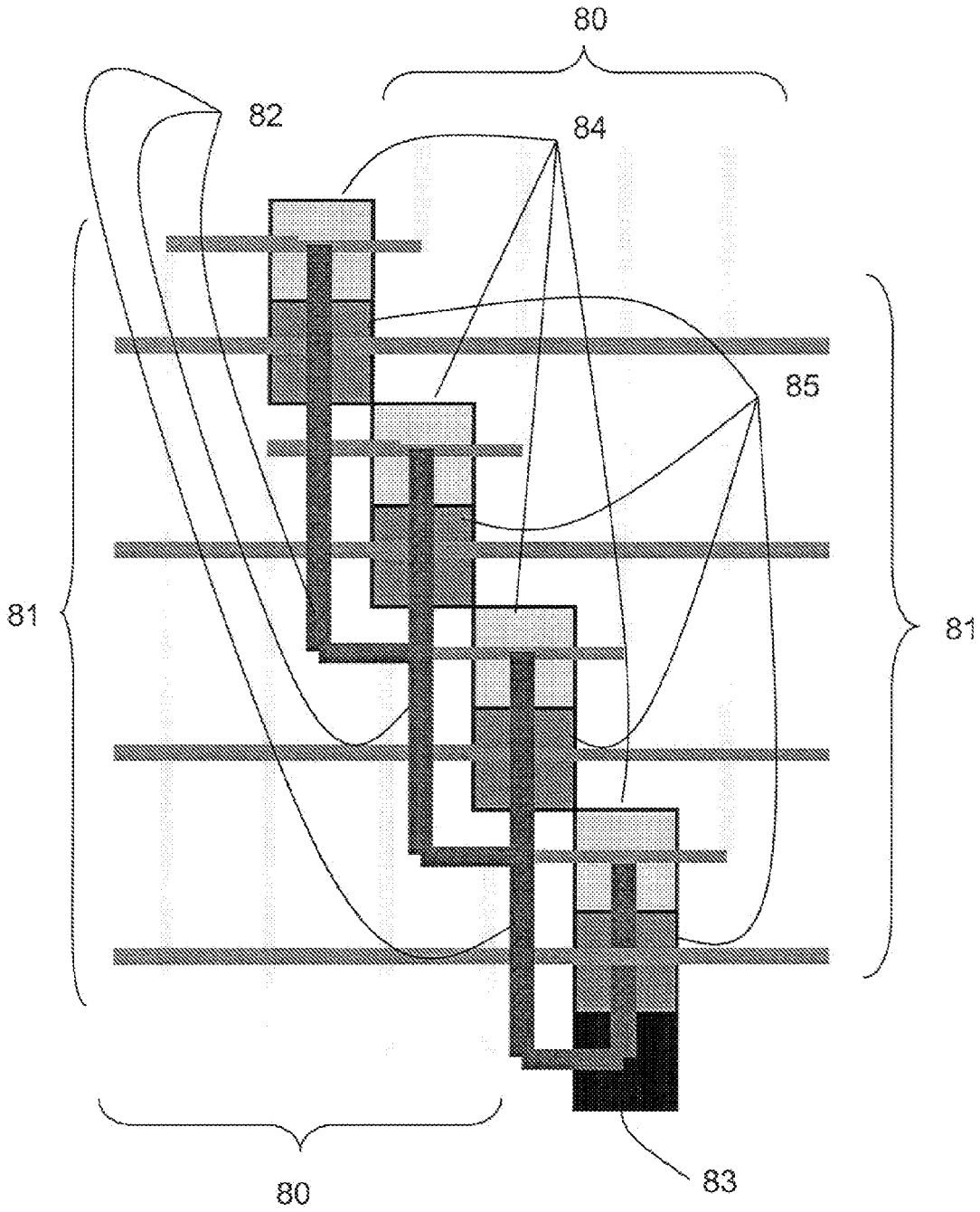
FIG. 8 shows a diagram of an exemplary implementation of a device that may be constructed using various embodiments of the invention.

Another example of an application of the MEMS-based programmable switching technology discussed above is shown in FIG. 8. FIG. 8 shows an exemplary implementation of a simple 4:1 multiplexor. In this figure, metal layer 80 may be considered to be at the bottom layer and may connect to four different drain connections as passing vertically (to other structures and destinations). The metal layer 81 may correspond to where gates and drains exist, and the layer 82 may be above the layer 81 and may correspond to where cantilevers are implemented. The squares 85 may correspond to areas of gate-cantilever cross-over, and the squares 84 may correspond to areas of drain-cantilever cross-over. The sources may all be connected together at the source layer, with a shared via to the substrate layer, and, for example, a CMOS circuit for buffering the output of the multiplexor. The box 83 indicates one possible location for this via, although it could be placed elsewhere, for example, but not necessarily limited to, anywhere else under layer 82 that does not have any other metal below it.

Various embodiments of the invention have been presented above. However, the invention is not intended to be limited to the specific embodiments presented, which have been presented for purposes of illustration. Rather, the invention extends to functional equivalents as would be within the scope of the appended claims. Those skilled in the art, having the benefit of the teachings of this specification, may make numerous modifications without departing from the scope and spirit of the invention in its various aspects.

What is claimed is:

1. An integrated circuit device including:

one or more logic components; and a programmable interconnect switch coupled to at least one of the one or more logic components and arranged to configure the integrated circuit device, the programmable interconnect switch comprising:

a source;

a deformable cantilever coupled to the source; and a drain;

at least one gate, wherein the cantilever is configured to form a conductive coupling with the drain upon application of a force that causes the cantilever to become deformed;

wherein the cantilever is configured to form a conductive coupling with the drain upon application of a force that causes the cantilever to become deformed;

wherein at least one component selected from among the group consisting of the at least one gate and the drain is configured to carry at least one signal to cause the cantilever to become deformed;

wherein the at least one selected component is further configured to carry a user signal when not carrying a signal to induce the force to cause the cantilever to become deformed.

2. The programmable interconnect switch according to claim 1, wherein the signal to induce the force comprises a voltage of a greater magnitude than the user signal.

3. The programmable interconnect switch according to claim 1, further comprising at least one gate, and wherein at least one component selected from among the group consisting of the at least one gate and the drain is configured to carry at least one signal to cause the cantilever, when conductively coupled to the drain, to break the conductive coupling with the drain.

4. The programmable interconnect switch according to claim 3, wherein the at least one selected component is further configured to carry a user signal when not carrying a signal to induce the force to cause the cantilever to break the conductive coupling with the drain.

5. The programmable interconnect switch according to claim 1, further comprising:

programming circuitry coupled to at least one conductive element, selected from the group consisting of the source, a gate, and the drain, to provide one or more signals to induce a force to cause the cantilever to form the conductive coupling with the drain or to break a previously-existing conductive coupling between the cantilever and the drain.

6. The programmable interconnect switch according to claim 5, wherein the programming circuitry comprises at least one pull-up circuit coupled to the source or the drain.

7. The programmable interconnect switch according to claim 6, wherein the at least one pull-up circuit comprises a transistor switch coupled to a programming supply voltage.

8. The programmable interconnect switch according to claim 5, wherein the programming circuitry comprises at least one pull-down circuit coupled to the source or the drain.

9. The programmable interconnect switch according to claim 8, wherein at least one pull-down circuit comprises a transistor switch coupled to a programming supply voltage.

10. The programmable interconnect switch according to claim 5, wherein the programming circuitry comprises at least one pull-up circuit coupled to a gate.

11. The programmable interconnect switch according to claim 10, wherein the at least one pull-up circuit comprises a transistor switch coupled to a programming supply voltage.

12. A method of programming a programmable integrated circuit device that includes logic and a programmable interconnect switch including a source, a deformable cantilever, and a drain, wherein the cantilever is configured to form a conductive coupling with the drain upon application of a force that causes the cantilever to become deformed, the method comprising:

directing a first signal through a conductive element within a switching region of the programmable interconnect switch of the programmable integrated circuit device to configure at least one of a portion of the logic or an interconnection of logic within the programmable integrated circuit device, wherein the first signal induces a force to cause the cantilever to perform an action selected from the group consisting of (a) deforming to form a conductive coupling with the drain; and (b) breaking a previously-established conductive coupling with the drain;

wherein the first signal causes the cantilever to burn out.

13. The method according to claim 12, wherein the conductive coupling is maintained by means of at least one force selected from the group consisting of van der Waals force and Casimir force, and wherein the first signal induces a force sufficient to overcome the at least one force.

14. The method according to claim 12, wherein the conductive element is selected from among the group consisting of the drain and at least one gate.

15. The method according to claim 12, wherein the method further comprises:

directing at least one further signal through at least one further conductive element within a switching region of the programmable interconnect switch, wherein the at least one further signal, in conjunction with the first signal, induces the force to cause the cantilever to perform the action selected from the group consisting of (a) deforming to form a conductive coupling with the drain; and (b) breaking a previously-established conductive coupling with the drain.

16. The method according to claim 15, wherein the programmable interconnect switch includes at least one gate, and wherein the conductive element and the at least one further conductive element are selected from the group consisting of the drain and the at least one gate.

17. A method of programming a programmable integrated circuit device that includes logic and a programmable interconnect switch including a source, a deformable cantilever, and a drain, wherein the cantilever is configured to form a conductive coupling with the drain upon application of a force that causes the cantilever to become deformed, the method comprising:

directing a first signal through a conductive element within a switching region of the programmable interconnect switch of the programmable integrated circuit device to configure at least one of a portion of the logic or an interconnection of logic within the programmable integrated circuit device, wherein the first signal induces a force to cause the cantilever to perform an action selected from the group consisting of (a) deforming to form a conductive coupling with the drain; and (b) breaking a previously-established conductive coupling with the drain;

wherein the first signal causes a portion of the cantilever, the drain, or both to melt and form a weld between the cantilever and the drain.

18. An integrated circuit device, comprising:

a first metal layer disposed in a first direction;

a second metal layer disposed in second direction perpendicular to the first direction and having one or more connections to the first metal layer; and a third layer, disposed in a direction parallel to the first metal layer and having at least one deformable cantilever disposed above one portion of plural parallel portions of the second metal layer;

wherein a first end of at least one cantilever is conductively coupled to a source conductor and a second end of the at least one cantilever is configured to form a conductive coupling with a drain conductor comprising at least one portion of the second metal layer upon application of a force that causes the cantilever to become deformed;

wherein the third layer comprises multiple deformable cantilevers coupled to a common source conductor, and wherein the integrated circuit device is configured to enable one or more voltages coupled to the second metal layer to cause the deformable cantilevers to cause the integrated circuit device to implement the function of a multiplexor.

19. The integrated circuit device according to claim 18, wherein at least one conductor selected from the group consisting of the drain conductor and the at least one gate conductor is configured to be coupled to a programming supply voltage to induce a force to cause the cantilever to become deformed or to break a pre-existing conductive coupling with the drain conductor.

20. The integrated circuit device according to claim 18, further comprising at least one via to couple at least one cantilever to a source conductor.

21. The integrated circuit device according to claim 20, wherein the source conductor is configured to be coupled to a programming supply voltage to induce a force to cause the cantilever to become deformed or to break a pre-existing conductive coupling with the drain conductor.

* * * * *